US008841982B2

(12) United States Patent
Devaux et al.

(10) Patent No.: US 8,841,982 B2
(45) Date of Patent: Sep. 23, 2014

(54) REDUCED NOISE HIGH- OR MEDIUM-VOLTAGE EQUIPMENT INCLUDING AN IMMERSED INDUCTION-ACTIVATED PORTION

(75) Inventors: Francois Devaux, Saint Maur des Fosses (FR); Pascal Vouagner, Fleurieu-sur-Saone (FR)

(73) Assignee: ALSTOM Technology Ltd, Baden (CH)

( * ) Notice: Subject to any disclaimer, the term of this patent is extended or adjusted under 35 U.S.C. 154(b) by 0 days.

(21) Appl. No.: 13/695,715

(22) PCT Filed: May 3, 2011

(86) PCT No.: PCT/EP2011/057062

§ 371 (c)(1), (2), (4) Date: Nov. 1, 2012

(87) PCT Pub. No.: WO2011/138329

PCT Pub. Date: Nov. 10, 2011

(65) Prior Publication Data

US 2013/0043965 A1 Feb. 21, 2013

(30) Foreign Application Priority Data

May 5, 2010 (FR) ..... 10 53509

(51) Int. Cl.

| | |
|---|---|
| ***H01F 27/02*** | (2006.01) |
| ***H01F 27/00*** | (2006.01) |
| ***F01N 1/06*** | (2006.01) |
| ***H01F 27/33*** | (2006.01) |

(52) U.S. Cl.

CPC ..... *H01F 27/33* (2013.01)
USPC ..... 336/94; 336/96; 336/90; 336/92; 336/100; 336/83; 181/210; 181/206

(58) Field of Classification Search

CPC ..... H01F 27/14; H01F 27/321; H01F 27/125; H01B 3/20; H01B 3/22; G10K 11/1788; G10K 11/178; G10K 11/175; F01N 1/065; G06F 1/20
USPC ..... 336/94, 96, 90, 92, 100, 83
See application file for complete search history.

(56) References Cited

U.S. PATENT DOCUMENTS

| | | | | |
|---|---|---|---|---|
| 1,846,887 | A | 2/1932 | Matthews | |
| 3,102,246 | A * | 8/1963 | Honey et al. | 336/100 |
| 3,305,813 | A | 2/1967 | Toothman et al. | |
| 4,514,714 | A * | 4/1985 | Kanoi et al. | 336/100 |
| 4,840,251 | A * | 6/1989 | Murase et al. | 181/206 |
| 5,121,811 | A * | 6/1992 | Shima et al. | 181/201 |

(Continued)

FOREIGN PATENT DOCUMENTS

| | | |
|---|---|---|
| DE | 4228101 A | 3/1994 |
| FR | 2730335 A1 | 8/1996 |

(Continued)

OTHER PUBLICATIONS

PCT Search Report in PCT Application Serial No. PCT/EP2011/057062, dated Jun. 10, 2011.

(Continued)

*Primary Examiner* — Elvin G Enad
*Assistant Examiner* — Kazi Hossain
(74) *Attorney, Agent, or Firm* — Nixon Peabody LLP

(57) ABSTRACT

High- or medium-voltage equipment comprising an induction-activated portion, a tank surrounding the active portion and filled with a dielectric fluid, such as oil, and passive acoustic reduction means for reducing acoustic waves coming from the active portion and propagating in the dielectric fluid. According to the invention, the passive means create an interference field that divides the propagated waves into two groups of waves of opposite phase that interfere with each other in a zone that is at a distance from the walls of the tank so as to at least limit the amplitude of the waves before they make contact with said walls. The equipment provides an effective solution for significantly reducing the noise that is propagated by the dielectric fluid medium.

7 Claims, 5 Drawing Sheets

(56) References Cited

U.S. PATENT DOCUMENTS 5,138,588 A 8/1992 Chuan et al.
6,661,322 B1 * 12/2003 Anger ..... 336/57

FOREIGN PATENT DOCUMENTS

GB 925522 5/1963
JP 59 172218 A 9/1984
JP 61 006812 A 1/1986

OTHER PUBLICATIONS

French Search Report in French Application Serial No. FR1053509, dated. Dec. 13, 2010.

* cited by examiner

REDUCED NOISE HIGH- OR MEDIUM-VOLTAGE EQUIPMENT INCLUDING AN IMMERSED INDUCTION-ACTIVATED PORTION

CROSS REFERENCE TO RELATED APPLICATIONS OR PRIORITY CLAM

This application is a National Phase of PCT/EP2011/057062, filed May 3, 2011, entitled, "HIGH- OR MEDIUM-VOLTAGE ELECTRICAL DEVICE INCLUDING A SUBMERGED ACTIVE INDUCTION PORTION HAVING REDUCED NOISE", which claims the benefit of French Patent Application No. 10 53509, filed May 5, 2010, the contents of which are incorporated herein by reference in their entirety.

TECHNICAL FIELD

The invention relates to high- or medium-voltage equipment, such as a transformer or an induction coil, including an induction-activated portion that is immersed in a dielectric fluid.

The invention relates to reducing the noise emission of such equipment.

More particularly, it relates to reducing the amount of noise due to the acoustic waves emitted by the induction-activated portion of the equipment and that propagate in the dielectric fluid medium until they reach the walls of the immersion tank filled with the dielectric fluid, such as oil.

Equipment for which the invention is particularly intended comprise induction coils and transformers, in particular power transformers and distribution transformers in an electricity distribution network.

PRIOR ART

In equipment, such as transformers or induction coils, having an induction-activated portion that is immersed in a dielectric fluid, it is known that a considerable portion of the noise radiated is due to the propagation of acoustic waves that are emitted by the induction-activated portion operating in the dielectric fluid medium and that propagate until they reach the walls of the tank that thus constitute dominant sound-radiating surfaces, so to speak.

Numerous solutions for reducing this portion of the noise have already been proposed in the prior art.

Here, mention may be made of the solutions described in very old patents GB 925 522, U.S. Pat. No. 3,102,246, and U.S. Pat. No. 3,305,813, which consist in increasing considerably the compressibility of the fluid by using an assembly of several flexible hollow tubes having series resonance in the dielectric fluid medium that is tuned to the frequency of the acoustic phenomena to be reduced. The frequency-local increase in the compressibility of the dielectric fluid medium modifies its apparent compressibility modulus, but in practical terms that does not prevent the acoustic waves emitted by the induction-activated portion from reaching, and therefore exciting, the walls of the tank. In other words, the solutions in those documents are not very effective because the walls of the tank continue to be significant sound-radiating surfaces and therefore the noise of the transformers remains high.

More recently, a solution has been proposed in U.S. Pat. No. 6,661,322: it consists in arranging cylindrical circular plates either against the walls of the tank, or around the active portion. These cylindrical plates also seek to considerably reduce the apparent compressibility of the dielectric fluid medium (in this example oil) in such a manner as to absorb the waves that propagate from the active portion towards the walls of the tank. Like the solutions described in the above-mentioned patents, increasing the apparent compressibility of the dielectric fluid medium in which the induction-activated portion is immersed does not guarantee any reduction in the excitation of the walls of the tank by the waves emitted by said active portion. In other words, such a solution does not prevent the waves emitted by the induction-activated portion from reaching the walls of the tank that therefore continue to be significant sound-radiating surfaces.

Improved noise reduction devices have already been proposed for difficult applications in which they are immersed in a liquid and subjected to very substantial hydrostatic pressures. Thus, U.S. Pat. No. 5,138,588 and French patent No. FR 2 730 335 describe noise reduction devices used in underwater acoustics and that are made up of tubular structures coated in an elastomer matrix in order to guarantee they are leaktight when immersed at a great depth. Provision is thus made for the tubular structures to be fastened to the hulls of ships in rigid manner. As such, they are not adapted for application in an equipment tank, such as a transformer, because they are too rigid.

That is why an object of the invention is to propose a solution to reduce effectively the portion of the noise from high- or medium-voltage equipment that is due to the acoustic waves that are emitted by the induction-activated portion and that propagate through the dielectric fluid medium surrounding said active portion.

A particular object of the invention is to propose a solution that is compatible with the technological and economic requirements of the field of transmitting and distributing electricity at high or medium voltage.

SUMMARY OF THE INVENTION

To do this, the object of the invention relates to high- or medium-voltage equipment comprising an induction-activated portion, a tank surrounding the active portion and filled with a dielectric fluid, such as oil, and acoustic reduction means for reducing acoustic waves coming from the active portion and propagating in the dielectric fluid.

The acoustic reduction means make it possible to divide the propagated waves into two groups of waves of opposite phase that interfere with each other.

According to the invention, the passive acoustic reduction means are hollow structural elements, leaktight to the dielectric fluid, arranged to be regularly spaced apart and to form a barrier at a distance from the walls of the tank, the space between two adjacent structural elements being adapted to let through a fraction of the waves coming from the active portion and propagating in the fluid without introducing any phase shift, thereby constituting one of the two wave groups, each structural element being adapted to be excited via an "inside" one of its faces by the other fraction of the waves coming from the active portion and propagating in the fluid, and to re-emit the other wave group in phase opposition to the first wave group via its opposite or "outside" face, and thus create the interference between the two wave groups, in a zone that is at a distance from the walls of the tank so as to at least limit the amplitude of the waves before they make contact with said walls.

The term "induction-activated portion" is used to cover electromagnetic induction elements, such as an electromagnetic circuit and windings in high- or medium-voltage transformers or in induction coils.

Advantageously, for simplicity of implementation and reduced production costs, the acoustic reduction means are passive means.

Thus, by means of the structural elements of the invention an acoustic barrier is formed and an interference field is created behind said barrier, i.e. in the zone situated between the acoustic barrier and the walls of the tank, by limiting the acoustic effect resulting from the mechanical excitement by acoustic waves of the walls of the tank containing the dielectric fluid.

In other words, the incident acoustic pressure waves generated by the components of the induction-activated portion and reaching the acoustic barrier formed by the structural elements of the invention split into two wave groups, of which:

one group passes through the barrier without introducing any phase shift; and the other group excites the inside face of the barrier (inside faces of all the structural elements) and is re-emitted in phase opposition via the outside faces of the structural elements of the barrier.

The resulting effect on the walls of the tank is thus minimized by a compensation mechanism between two virtual sources, the first (Q+) being associated with the incident wave and passing through the barrier, and the second (Q−) being associated with the incident wave that excites the structural elements of the barrier and that is re-emitted in phase opposition by said structural elements. The compensation mechanism of the invention obtained by the structural elements constituting the barrier is shown in FIG. 3.

In other words, the invention consists essentially in implementing a noise reducer inside an equipment tank filled with dielectric fluid, which noise reducer reduces noise by dividing up the incident waves and organizing phase opposition between said divided waves. The noise reducer of the invention is passive, i.e. it does not require the use of any electrical and/or mechanical active means in order to implement the phase opposition interference field.

In a variant, the structural elements include metal tubes of constant inside section along their height, each tube being closed at each of its ends by a device that is leaktight against the dielectric fluid.

The structural elements are preferably mounted inside the tank by vibration decoupling means. A significant reduction of low-frequency noise is thus obtained, associated with the transfer of acoustic energy by the dielectric fluid.

For reasons of simplicity of implementation and in order not to modify the design of the other elements of the equipment, such as the tank, provision is made for fastening by the vibration decoupling means to take place via a rigid frame arranged in the tank.

In order to ensure that an interference field is sufficiently strong, the surface area of the structural elements is not less than two-thirds of the surface area of the barrier.

The invention also relates to above-described equipment that constitutes a transformer or an induction coil.

The person skilled in the art should take care to seek optimum effectiveness at a given frequency in the design and implementation by adjusting the following parameters:

the shape and material used for structural elements (metal or non-metal), as well as the nature of its contents (gas, foam, or elastomer), thereby conditioning the conversion between the incident wave and the wave re-emitted in phase opposition by said structures. In particular, care should be taken to define a shape and one or more materials in order to ensure compensation occurs between the waves re-emitted by the adjacent structural elements and those passing through the spaces between them without phase inversion;

the pitch of the acoustic barrier, i.e. the distance between two adjacent structural elements, that determines the distribution between the respective contributions of the incident wave and the wave that is re-emitted behind the barrier. As indicated above, the pitch must be such that it enables the structural elements to cover at least two-thirds of the total surface area of the barrier;

the distance of the barrier from the walls of the tank. This distance should be sufficient to enable the interference field of the invention to occur between the barrier and the walls of the tank; and the characteristics of the dielectric fluid (mineral oil or other).

Thus, once these parameters are adjusted in optimum manner for a given frequency, the interference field obtained can reduce to zero the resultant pressure of the waves prior to making contact with the walls of the transformer tank (P=0).

BRIEF DESCRIPTION OF THE DRAWINGS

Other advantages and characteristics appear more clearly on reading the detailed description made with reference to the following figures, in which.

DETAILED DESCRIPTION OF PARTICULAR EMBODIMENTS

Figure 1:
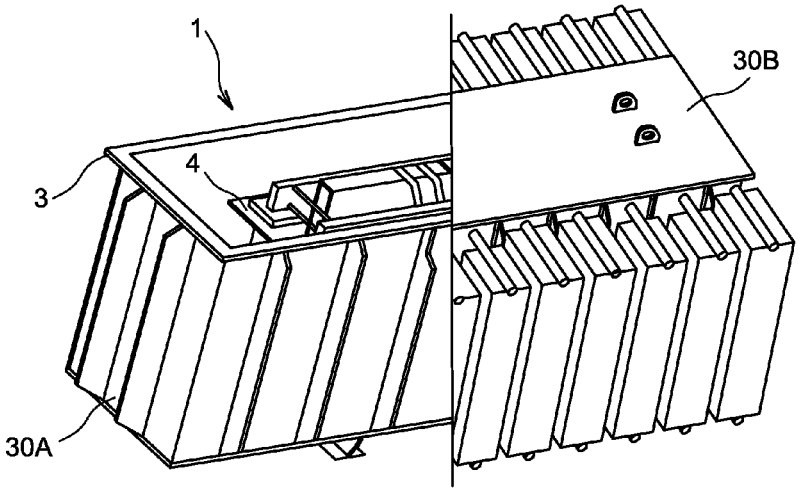
FIG. 1 is a fragmentary perspective view of a transformer of the invention.

FIG. 1 shows a transformer 1 in which an acoustic barrier 2 of the invention is arranged at a distance from the vertical walls 30A and from the top 30B of the tank 3.

As shown, the transformer 1 includes an induction-activated portion 4 immersed in dielectric oil (not shown) that fills the tank 3.

Figure 2:
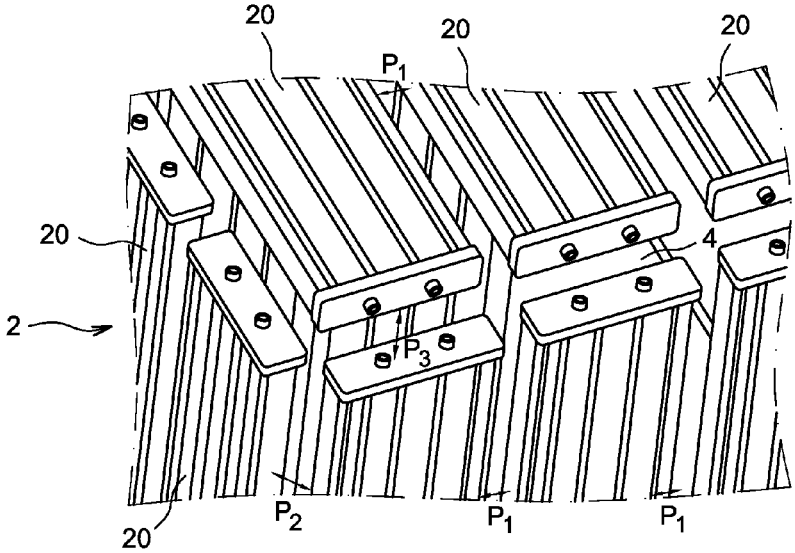
FIG. 2 is a fragmentary perspective view of an acoustic barrier in an embodiment of the invention arranged inside the tank of the transformer of FIG. 1.

In the embodiment shown in FIG. 2, the acoustic barrier 2 is of the passive type and is constituted by hollow metal tubes 20 that are leaktight against the dielectric oil, and that are regularly spaced apart from one another. More precisely, a regular pitch p1 separates two adjacent tubes 20 at a distance from a single wall, a distance p2 separates two adjacent tubes 20 at a corner between two vertical walls 30, and a distance p3 separates two adjacent tubes 20 between one of the vertical walls 30A and a top wall 30B.

The hollow tubes 20 shown in FIG. 2 are of substantially rectangular cross-section. This substantially rectangular shape ensures good compliance of the hollow tubes 20 and therefore good reduction of low-frequency noise.

In the invention, the regular pitches thus define a space between two tubes 20 that is adapted to pass therethrough a fraction of the pressure waves coming from the induction-activated portion 4 and propagating in the oil, without introducing any phase shift, and thus constituting one wave group. Each hollow tube 20 is adapted to be excited via its inside face 200, i.e. the face facing the active portion 4, by the other fraction of the waves coming from the active portion and propagating in the oil, and to re-emit another wave group that is in phase opposition. Thus, an interference field is created between these two wave groups.

Figure 3:
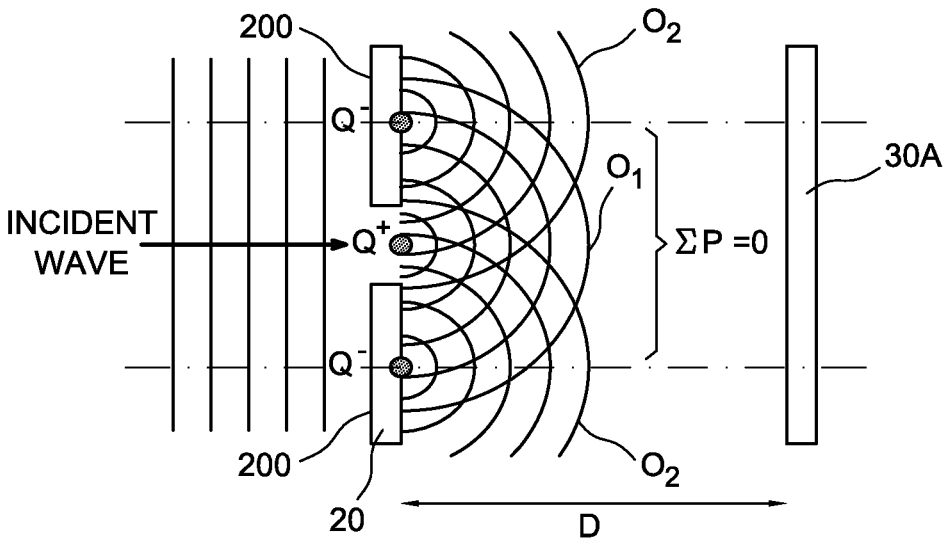
FIG. 3 is a diagram showing the behavior of an acoustic barrier of the invention.

FIG. 3 shows the creation of an interference field by phase inversion between the wave fraction O1 that comes from the incident waves that pass through the barrier 2, and the fraction O2 that is re-emitted by each of the hollow tubes 20: compensation thus takes place between the two virtual wave sources Q+, Q− that are created. By adjusting the parameters constituted by: the shape and the material of the tubes 20; the pitch of the barrier 2; the distance separating the barrier 2 from the walls 30A, 30B of the tank 3; and the characteristics of the oil, it is possible to cancel out completely the resultant pressure waves before they make contact with the walls ($\Sigma P=0$).

The dimensions of the hollow tubes 20 and the value of the regular spacing pitches are preferably adapted so that the barrier 2 totally covers the periphery of the induction-activated portion 4 at the distance D from the vertical and top walls 30A, 30B.

As a function of the characteristics of the waves in question, the hollow tubes 20 of the invention that are leaktight against dielectric oil may be filled either with a light fluid (gas), or with a flexible material (foam or elastomer).

Figure 4:
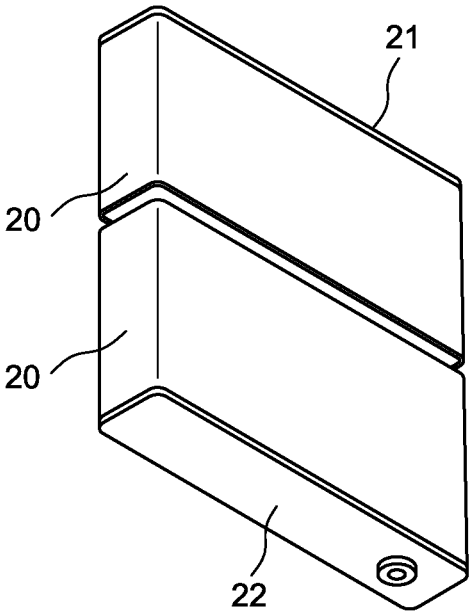
FIGS. 4 and 5 are cross-section views in perspective of a structural element of the acoustic barrier in first and second variant embodiments respectively.
Figure 5:
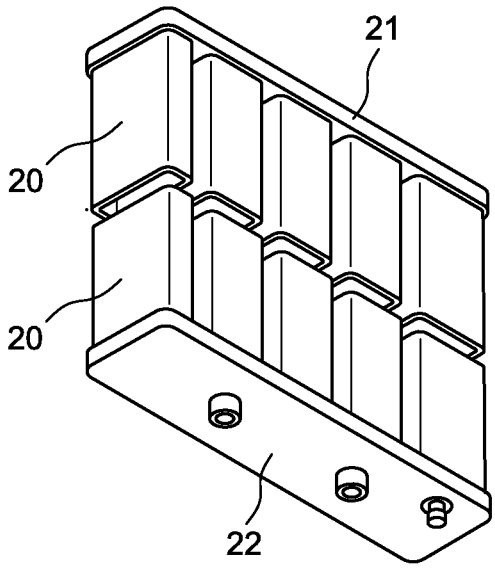

Two variant embodiments of hollow tubes of rectangular section are shown in FIGS. 4 and 5:

the hollow tube 20 of rectangular section as shown in FIG. 4 is a folded and welded tube sealed by two welded plates 21, 22 and it is filled with a gas.

the hollow tubes 20 of rectangular section as shown in FIG. 5 are extruded tubes sealed by two endplate-forming fastener devices 21, 22 for all of the tubes and they are filled with a gas.

In order to obtain a significant reduction of low-frequency noise, associated with the transfer of acoustic energy by the dielectric oil, provision is advantageously made to mount the hollow tubes 20 in the tank 3 via vibration decoupling means.

Figure 6A:
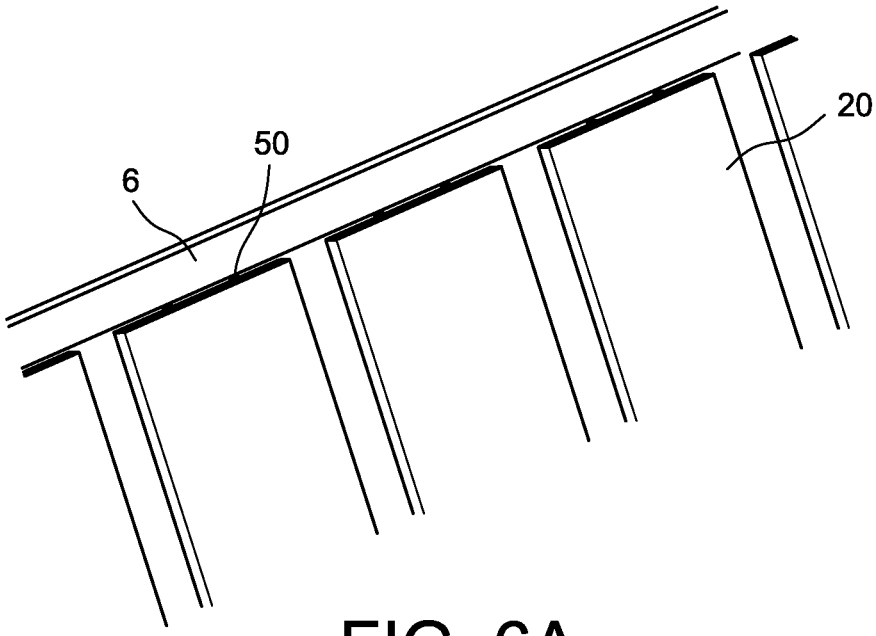
FIGS. 6A and 6B are perspective views showing the mounting of a structural element of the acoustic barrier in first and second variant embodiments respectively.
Figure 6B:
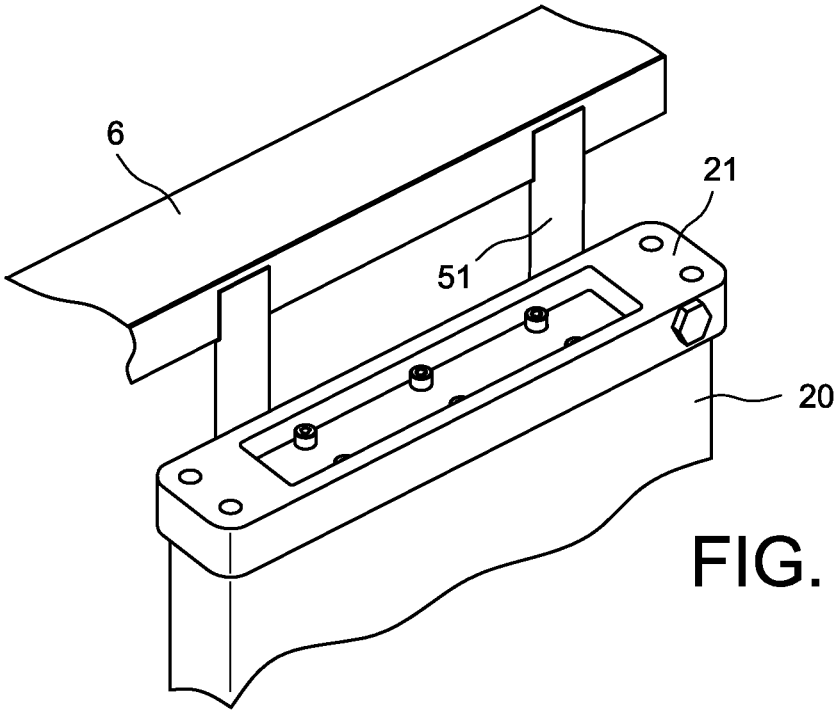

Two variant embodiments for mounting via vibration decoupling means are shown in FIGS. 6A and 6B:

the hollow tubes 20 of FIG. 6A are fastened by means of lugs 50 to a rigid frame 6 arranged in the tank 3;

the hollow tubes 20 of FIG. 6B are fastened by means of flexible blades 51 to a rigid frame 6 arranged in the tank 3. Such mounting is advantageous in that it enables modular assemblies of a plurality of tubes 20 to be manipulated and therefore simplifies putting the acoustic barrier into place in the tank of the equipment.

An advantage of mounting the acoustic barrier 2 on an intermediate fastening frame 6 is simplicity of implementation.

Figure 7:
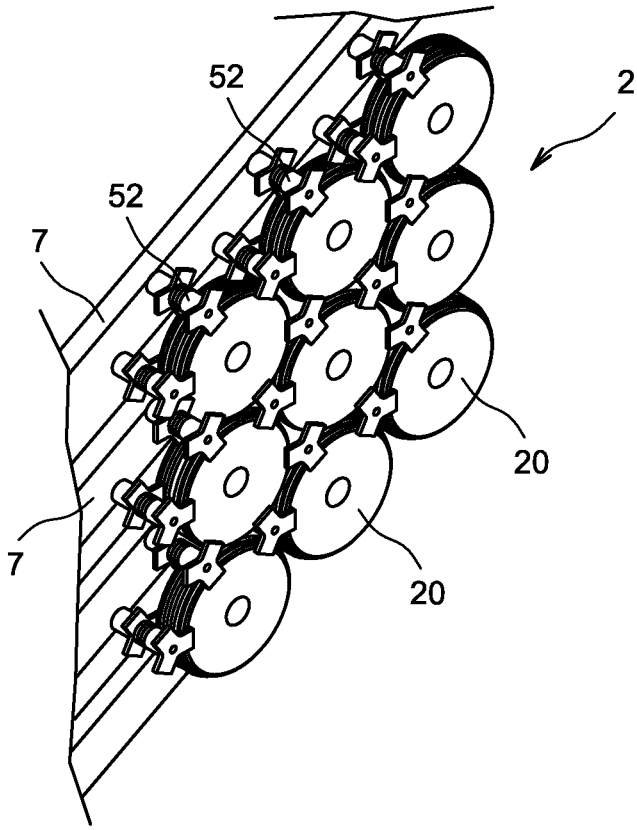
FIG. 7 is a fragmentary perspective view of an acoustic barrier in another embodiment of the invention.

Another embodiment of the acoustic barrier 2 of the invention is shown in FIG. 7: in this example, the hollow tubes 20 are cylindrical and fastened on rails 7 by means of fasteners 52 made of compressible material, making it possible to perform vibratory decoupling between tubes 20 and rails 7.

Acoustic tests have been performed with success on a line transformer of 160 kilovolt amps (kVA) made on a small scale with a passive acoustic barrier of the invention. Other acoustic tests were performed with success on a power transformer of 40 megavolt amps (MVA) made on an industrial scale with a passive acoustic barrier of the invention.

Figure 8:
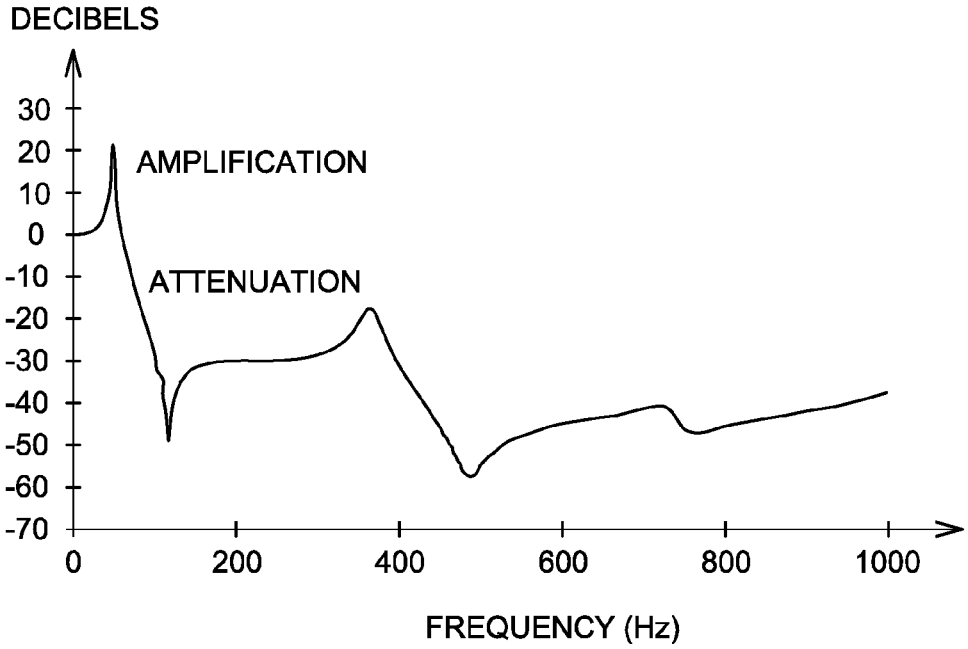
FIG. 8 is a graph showing the effectiveness of an acoustic barrier of the invention.

In FIG. 8, the curve shows the acoustic reduction of the barrier 2 of the invention, plotted in decibels (dB) as a function of the noise frequencies emitted by the induction-activated portion 4: it can be seen clearly that the acoustic barrier 2 enables efficient noise reduction above a frequency of 100 hertz (Hz).

Other improvements and variant embodiments may be envisaged without going beyond the ambit of the present invention.

Thus, tubes may be envisaged of various sections: square, rectangular, cylindrical.

It may also be envisaged to put the inside volume of the tubes into contact with a medium outside the tank of the transformer, or with a medium inside the tank of the equipment, but that is separate from the dielectric fluid.

An acoustic barrier partially surrounding the inside of a high- or medium-voltage equipment tank may be envisaged, in particular when the induction-activated portion emits waves along a preferred direction. Thus, it may be envisaged to implant an acoustic barrier of the invention solely facing the side faces of the tank of the equipment.

As a function of the configuration of the equipment, an acoustic barrier of the invention could be implemented on the bottom of the tank. In practice, in current configurations of equipment, such as transformers, it is entirely possible to envisage a solution involving a double-walled arrangement with dielectric fluid-tank bottom-air-box that is satisfactory for the reduction of noise towards the bottom of the tank.

The invention claimed is:

1. High- or medium-voltage equipment comprising an induction-activated portion, a tank surrounding the active portion and filled with a dielectric fluid, such as oil, and passive acoustic reduction device for reducing acoustic waves coming from the active portion and propagating in the dielectric fluid, said acoustic reduction device arranged so as to divide the propagated waves into two groups of waves of opposite phase that interfere with each other, the passive acoustic reduction device being several hollow structural elements leaktight to the dielectric fluid, arranged to be regularly spaced apart and to form a discontinuous barrier at a distance from the walls of the tank, the space between two adjacent structural elements being adapted to let through a first fraction of the waves coming from the active portion and propagating in the fluid without introducing any phase shift, thereby constituting one of the two wave groups, each structural element being adapted to be excited via its inside face by the second fraction of the waves coming from the active portion and propagating in the fluid, and to re-emit the second wave group in phase opposition with said first group, said distance between said discontinuous barrier and said tank walls being provided such that second wave group is re-emitted in a zone that is at a distance from the walls of the tank so that said first group and said second group of waves interfere before they make contact with said walls.

2. Equipment according to claim 1, wherein the structural elements include tubes of constant inside section along their height, each tube being closed at each of its ends by a device that is leaktight.

3. Equipment according to claim 1, wherein the structural elements are mounted inside the tank by vibration decoupling device.

4. Equipment according to claim 3, wherein the structural elements are fastened to a rigid frame by vibration decoupling device.

5. Equipment according to claim 2, wherein the surface area of the structural elements is not less than two-thirds of the surface area of the barrier.

6. Equipment according to claim 1 constituting a transformer.

7. Equipment according to claim 1, constituting an induction coil.

* * * * *